US007887165B2

(12) United States Patent
Okazaki et al.

(10) Patent No.: US 7,887,165 B2
(45) Date of Patent: Feb. 15, 2011

(54) SEALING STRUCTURE

(75) Inventors: Naoya Okazaki, Gifu-ken (JP); Yoichiro Shimizu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1024 days.

(21) Appl. No.: 11/535,743

(22) Filed: Sep. 27, 2006

(65) Prior Publication Data

US 2007/0070131 A1 Mar. 29, 2007

(30) Foreign Application Priority Data

Sep. 28, 2005 (JP) ..... 2005-282106

(51) Int. Cl.
*B41J 2/17* (2006.01)

(52) U.S. Cl. ..... 347/84

(58) Field of Classification Search ..... 347/65, 347/85, 86, 84, 87, 50; 277/529, 500
See application file for complete search history.

(56) References Cited

U.S. PATENT DOCUMENTS

| | | | | |
|---|---|---|---|---|
| 2,684,262 | A * | 7/1954 | Neesen | 277/529 |
| 3,031,200 | A * | 4/1962 | Hamer | 277/500 |
| 6,652,081 | B2 | 11/2003 | Shimizu | |
| 6,808,256 | B2 | 10/2004 | Umeyama et al. | |
| 2002/0071002 | A1 * | 6/2002 | Kawamura et al. | 347/50 |
| 2003/0090540 | A1 | 5/2003 | Shimizu | |
| 2005/0122380 | A1 * | 6/2005 | Nakamura et al. | 347/65 |
| 2006/0028519 | A1 * | 2/2006 | Nakamura et al. | 347/87 |

FOREIGN PATENT DOCUMENTS

| | | | |
|---|---|---|---|
| CN | 1666873 | * | 9/2005 |
| EP | 0827836 | A1 | 3/1998 |
| EP | 1336499 | A2 | 8/2003 |
| JP | 2003145791 | | 5/2003 |
| JP | 2003237072 | | 8/2003 |
| JP | 200627003 | | 2/2006 |

OTHER PUBLICATIONS

European Patent Office, European Search Report for EP Appl'n No. 06020186 (counterpart to above-captioned patent appl'n) mailed Mar. 2, 2007.

* cited by examiner

*Primary Examiner*—Stephen D Meier
*Assistant Examiner*—Carlos A Martinez, Jr.
(74) *Attorney, Agent, or Firm*—Baker Botts L.L.P.

(57) ABSTRACT

A sealing structure includes a first and a second passage-forming member, and an elastic member interposed between the surfaces and including: a plate-like body which has an inlet-side and an outlet-side surface and through which through-holes are perpendicularly formed, a first protruding portion protruding from one of the inlet-side and outlet-side surfaces in an axial direction of the through-holes to contact the first passage-forming member and a second protruding portion axially protruding from the other surfaces toward the second passage-forming member. The inner circumferential surface of one of the first protruding portion and those of the corresponding second protruding portion and through-hole are continuous to form a smooth surface.

14 Claims, 10 Drawing Sheets

SEALING STRUCTURE

INCORPORATION BY REFERENCE

The present application is based on Japanese Patent Application No. 2005-282106, filed on Sep. 28, 2005, the contents of which are incorporated herein by reference.

BACKGROUND OF THE INVENTION

1. Field of the Invention

The present invention relates to a sealing structure, and particularly to a connecting structure between a fluid supply member and a fluid receiving member which receives a fluid from the fluid supply member. For instance, the invention relates to a structure of connecting a head unit with an ink supply member via an elastic member to receive an ink from the ink supply member, in an inkjet printer which ejects droplets of the ink from a plurality of nozzles onto a recording medium to record information or an image.

2. Description of Related Art

JP-A-2003-145791 (see FIGS. 5 and 10) discloses a sealing structure in an inkjet printer including an ink source, an elastic tube, an ink tank as a fluid supply member and a head unit, and a carriage on which the ink tank and the head unit are mounted. An ink is supplied from the ink source to the ink tank through the tube, and the ink tank and the head unit are connected with each other to allow ink communication therebetween. An O-ring is disposed at the connection between the ink tank and the head unit.

JP-A-2003-237072 discloses a liquid-droplet ejecting apparatus including a tank storing a recording liquid, a head chip for ejecting droplets of the recording liquid therefrom, a frame body holding the tank and the head chip, and a sealing member disposed at connection between the head chip and the frame body.

The sealing member disclosed in the latter publication has a plate-like body in which a through-hole is formed to supply therethrough the recording liquid from the tank to the head chip. On each of two opposite surfaces of the plate-like body, a double rib, namely, a combination of an inner annular rib and an outer annular rib, is disposed along a circumference of the plate-like body and on the radially outer side of the through-hole. The double ribs on the opposite surfaces of the plate-like body are symmetrical to each other in position and in shape with respect to the plate-like body. A positioning protrusion is formed on one of the opposite surfaces of the sealing member, on the radially inner side of the inner annular rib and on the radially outer side of the through-hole, so as to facilitate positioning of the sealing member, that is, the positioning protrusion is fitted in a blind hole formed in one of two members which hold the elastic member therebetween. According to the sealing member, at the connection between the head chip and the frame body, a high liquid-tightness or sealability is obtained without close or tight engagement of the head chip with the frame body, such as fitting.

In addition, the present applicant has devised a sealing structure for liquid-tightly connecting an ink tank storing four inks, with a cavity unit of a head unit held by a head holder, via an elastic sealing member and a reinforcing frame interposed between the elastic sealing member and the head unit, for supplying the inks in the ink tank to the cavity unit. The elastic sealing member has a plate-like body in which four through-holes are arranged in a row. Four discrete first protruding portions are formed on one of two opposite surfaces of the plate-like body to encircle open ends of the respective through-holes. That is, each of the first protruding portions is annular in plan view. A single second protruding portion, which is also annular in plan view, is formed on the other surface of the plate-like body, to encircle the other open ends of all the through-holes. Four ink outlet ports open in an under surface of the ink tank and four ink inlet ports open in an upper surface of the cavity unit are connected to each other via the through-holes in the elastic member and four through-holes formed in the reinforcing frame. On the under surface of the ink tank, there are formed a double rib, namely, a combination of four inner annular ribs encircling open ends of the respective ink outlet ports, and a common outer annular rib disposed on the outer side of all the inner ribs to define a groove between the inner ribs and the outer rib. With the second protruding portion of the elastic member fitted in the groove, the ink tank is screwed to the reinforcing frame, thereby compressing the elastic member to hold the first protruding portions in close contact with the reinforcing frame and to hold the second protruding portion closely fitted between the inner ribs and the outer rib of the ink tank, that is, closely fitted in the groove.

This sealing structure by the present applicant has several drawbacks.

First, when the first protruding portions of the elastic member are brought into close contact with the reinforcing frame, it is impossible to visually check whether the first protruding portions are perfectly contacted with the reinforcing frame, due to presence of the head holder. Where the first protruding portions are not properly positioned with respect to the reinforcing frame, ink leakage will occur.

Secondly, the first protruding portions of the elastic member may be displaced or deformed to incline due to a compressing force imparted on the elastic member upon screwing of the ink tank to the reinforcing frame. In particular, outermost two of the first protruding portions arranged in a row tend to deform. When the elastic member is compressed, the plate-like body of the elastic member, which is in contact with the ink tank, receives a force from the ink tank. At each of two opposite outermost portions of the plate-like body in a direction of arrangement of the first protruding portions, i.e., a direction of a row of the first protruding portions, the elastic member protrudes, in the form of a first protruding portion, toward the reinforcing frame, only at a side of or adjacent to the through-hole. In other words, extreme end portions of the plate-like body in the direction of the row of the first protruding portions are not supported by a first protruding portion from the under side. Hence, the force from the ink tank tends to incline, inward or to the side of the through-hole, a linear part of each outermost first protruding portion, which part is on the outer side in the direction of the row of the first protruding portions. This leads to deterioration in the liquid-tightness or sealability between the first protruding portions and the reinforcing frame.

Thirdly, since inner circumferential surfaces of the ink outlet ports and ink inlet ports, and those of the through-holes of the elastic member are disposed to cooperate to constitute four substantially continuous circumferential surfaces each defining an ink passage therein, it may occur that some one of the first protruding portions deforms or inclines to be located in the through-holes of the elastic member, or falls into the through-holes of the reinforcing frame or the ink inlet ports formed in the cavity unit when the first protruding portions are positioned with great error with respect to the reinforcing frame, or when the compressing force is too great. Such deformation or inclination of the first protruding portion leads to deterioration in the sealability that may result in ink leakage from the outermost portions of the plate-like body in the direction of the row of the through-holes.

When the sealability offered by the sealing structure is deteriorated due to any of the above-described reasons, an ambient air may be introduced into the ink passages, or mixing of colors of the inks may occur due to leakage of the inks. Hence, in manufacture of an inkjet printer including the sealing structure, the sealing structure is inspected for defects in regard to the connection of the elastic member, that is, an inspection for ink leakage is implemented, to get rid of a defective piece. Due to inclusion of this inspection step, the production cost of the inkjet printer increases. Further, when any piece is determined to be defective in the inspection, not only the elastic sealing member but an entirety of the head holder, in which the elastic member is mounted together with other members such as the ink tank and the head unit, is wastefully discarded.

Fourthly, since the elastic member functions to seal the connection between the ink outlet ports and the through-holes of the reinforcing frame, by the second protruding portion thereof being closely fitted in the groove while end portions of the first protruding portions being contacted with the reinforcing frame to receive a compression force therefrom, the elastic member should have a sufficient dimension in an axial direction of the through-holes of the elastic member, to accommodate a variation in an amount by which the end portions of the first protruding portions are compressed, which variation results from a variation in the compressing force. Displacement or the deformation or inclination of the first protruding portions as described above may be eliminated by reducing the dimension of the elastic member in this direction (hereinafter, a dimension of any member or part in the axial direction of the through-holes of the elastic member, which is parallel to an axial direction of the ink inlet ports and of the ink outlet ports, may be simply referred to as a "height" of that member or part). However, when the height of the elastic member is reduced, the load that the elastic member receives inevitably increases because the first protruding portions should be compressed by a sufficient degree to ensure a sufficient sealability. In this case, a reacting force from the elastic member to the increased load acts on the ink tank and the head unit that are in direct and indirect contact with the elastic member, respectively. This may cause undesirable deformation of the ink tank and the head unit.

Meanwhile, to meet demands for higher print rate, recent inkjet printers are enhanced in the print rate and increased in the number and density of nozzles arranged in the cavity unit, with increase in an amount of ink ejected per unit time. On the other hand, there is a demand for reduction in the size of the inkjet printers, too, and thus components of the recent inkjet printers are reduced in the overall size and thickness. In view of these trends, it is not desirable to increase the size of components that relate to ink supply, such as ink tank and ink outlet ports, even though increase in the size of these components can contribute to enable increase in the amount of ink ejected per unit time. In the above-described sealing structure using the O-ring, for instance, a diameter of the O-ring may be increased to enable increase in the ink consumption rate, but the increase in the diameter of the O-ring leads to increase in the size of the head unit. In addition, when the O-ring is assembled, or fixed to a relevant engaging portion, a portion of the O-ring, a height of which is half a total height or thickness of the O-ring, should be engaged with the engaging portion, and thus the O-ring is compressible only by an amount or a height corresponding to the rest half of the O-ring at the maximum when receiving a compressing force from two members holding the O-ring therebetween. Thus, the maximum amount by which the O-ring is compressible is relatively small which means that the O-ring can not contact sufficiently tightly with the members holding the O-ring therebetween, or can not provide a desired sealability.

SUMMARY OF THE INVENTION

This invention has been developed in view of the above-described situations, and it is an object of the invention to provide a sealing structure which ensures a sufficiently high sealability at connection between a fluid inlet port and a fluid outlet port.

To attain the above object, the invention provides a sealing structure including a first passage-forming member, a second passage-forming member, and an elastic member. The first passage-forming member has a surface in which open ends of one of (i) a plurality of fluid inlet ports, and (ii) fluid outlet ports of the same number as the fluid inlet ports, are arranged. The second passage-forming member has a surface in which open ends of the other of (i) the fluid inlet ports and (ii) the fluid outlet ports, are arranged. The elastic member is interposed between the surface of the first passage-forming member and the surface of the second passage-forming member, and includes a plate-like body, through-holes, a first protruding portion, and a second protruding portion. The plate-like body has two opposite surfaces one of which is an inlet-side surface on the side of the fluid inlet ports and the other of which is an outlet-side surface on the side of the fluid outlet ports. The through-holes are formed perpendicularly through the plate-like body such that the fluid inlet ports and the fluid outlet ports are communicated with each other via the through-holes, and the open ends of the fluid inlet ports and the open ends of the fluid outlet ports are smaller than respectively opposed open ends of the corresponding through-holes. The first protruding portion protrudes from one of the inlet-side and outlet-side surfaces in an axial direction of the through-holes toward the surface of the first passage-forming member to form inner circumferential surfaces encircling the open ends of the respective through-holes. The first protruding portion is held in contact with the surface of the first passage-forming member. The second protruding portion protrudes from the other of the inlet-side and outlet-side surfaces in the axial direction of the through-holes toward the surface of the second passage-forming member to form inner circumferential surfaces encircling the open ends of the respective through-holes. Each of the inner circumferential surfaces of the first protruding portion, an inner circumferential surface of a corresponding one of the through-holes, and a corresponding one of the inner circumferential surfaces of the second protruding portion are continuous with one another to cooperate to form a smooth circumferential surface. A part of each of the first and second protruding portions is located between each two adjacent through-holes being in the form of a common partition wall which separates the two adjacent through-holes from each other and extends along the axial direction of the through-holes.

The sealing structure is suitably employed where sealability with respect to supply of a liquid is to be ensured.

According to the sealing structure, the plate-like body has, on respective opposite sides thereof, i.e., on the sides of the fluid inlet ports and fluid outlet ports or vice versa, the first and second protruding portions that protrude in the axial direction of the through-holes to encircle the open ends of the through-holes on the opposite sides. By compressing the first and second protruding portions, fluid-tightness is ensured at each of the through-holes, thereby preventing leakage of a fluid from each of the through-holes, and mixing of a fluid supplied through one of the through-holes with a fluid supplied through another of the through-holes.

The first protruding portion and second protruding portion have surfaces which are formed to be continuous from the inner circumferential surfaces of the plate-like body defining the through-holes, to serve as common partition walls each separating two adjacent through-holes and extending in the axial direction of the through-holes. The open ends of the fluid inlet ports and those of the fluid outlet ports are smaller than the respectively opposed open ends of the through-holes. Thus, even when an end portion of the first protruding portion contacted with the first passage-forming member deforms and inclines greatly, a position of the contact between the end portion of the first protruding portion and the first passage-forming member is apart from the fluid inlet ports or the fluid outlet ports, thereby preventing the end portion of the first protruding portion from falling into the fluid inlet or outlet ports. Thus, fluid-tightness or sealability is ensured, and leakage of the fluid from each through-hole and mixing of the fluids supplied through the respective through-holes are prevented. This contributes to reduce the number of defective pieces found and discarded during a production process of apparatuses including the sealing structure, as well as the production cost thereof.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described an inkjet printer including a sealing structure according to one embodiment of the invention, by referring to the accompanying drawings.

Figure 1:
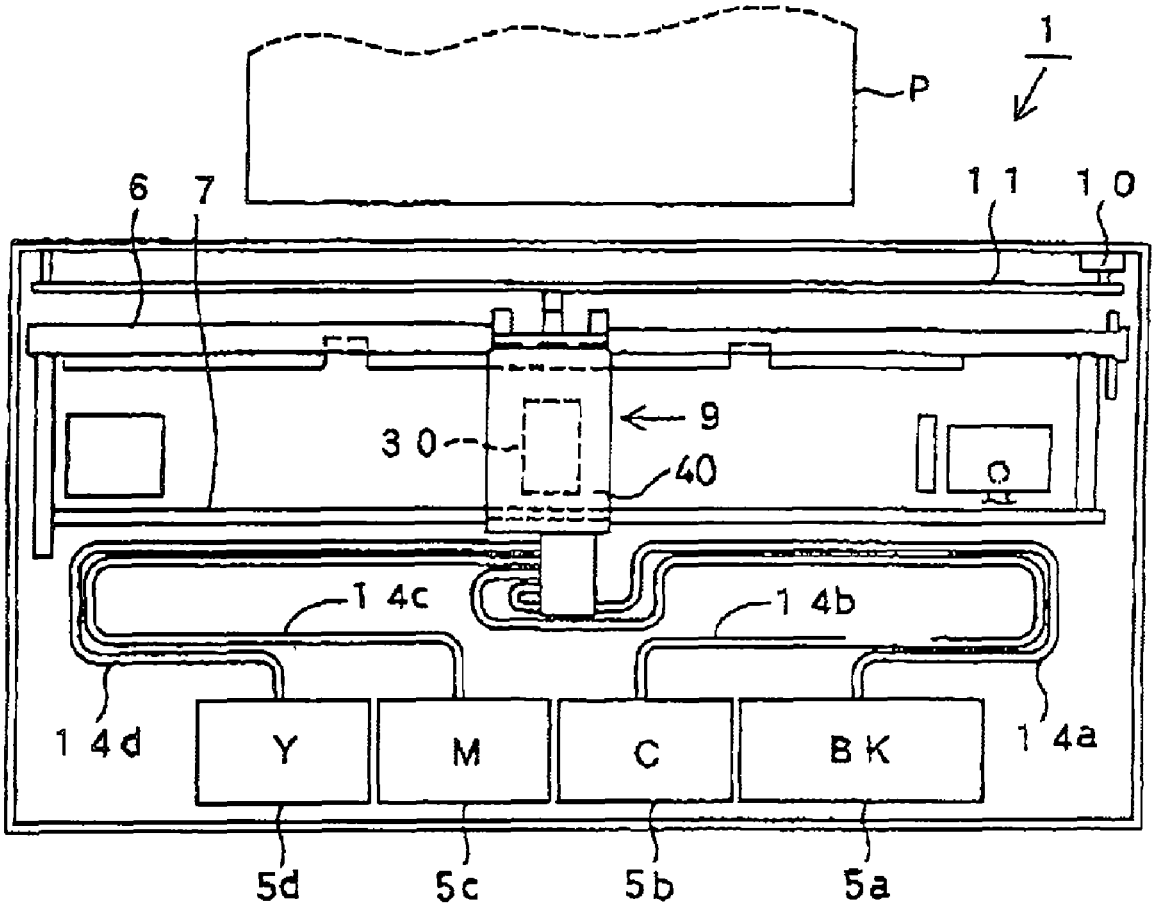
FIG. 1 is a plan view of an inkjet printer according to one embodiment of the invention.

Referring to FIG. 1, reference numeral 1 generally designates the inkjet printer including the sealing structure according to the embodiment of the invention. Two guide rods 6, 7 are disposed in the inkjet printer 1. On the guide rods 6, 7, there is mounted a head holder 9 serving as a carriage as well as a holder of a head unit 30. Droplets of ink are ejected from the head unit 30 onto a recording medium P, to record information or an image thereon. In the following description, the side to which ink droplets are ejected from the head unit 30 will be referred to as lower side, and the side opposite thereto will be referred to as upper side. The head holder 9 is coupled with an endless belt 11 circulated by a motor 10. When the motor 10 is operated, the head holder 9 moves along the guide rods 6, 7.

The inkjet printer 1 is equipped with ink cartridges 5*a*-5*d* accommodating inks of respective colors, namely, a black ink, a cyan ink, a magenta ink, and a yellow ink. The ink cartridges 5*a*-5*d* are disposed in a main body of the inkjet printer 1 and connected to an ink tank 40 that is mounted on the head holder 9, via respective elastic ink supply tubes 14*a*-14*d*.

Figure 2:
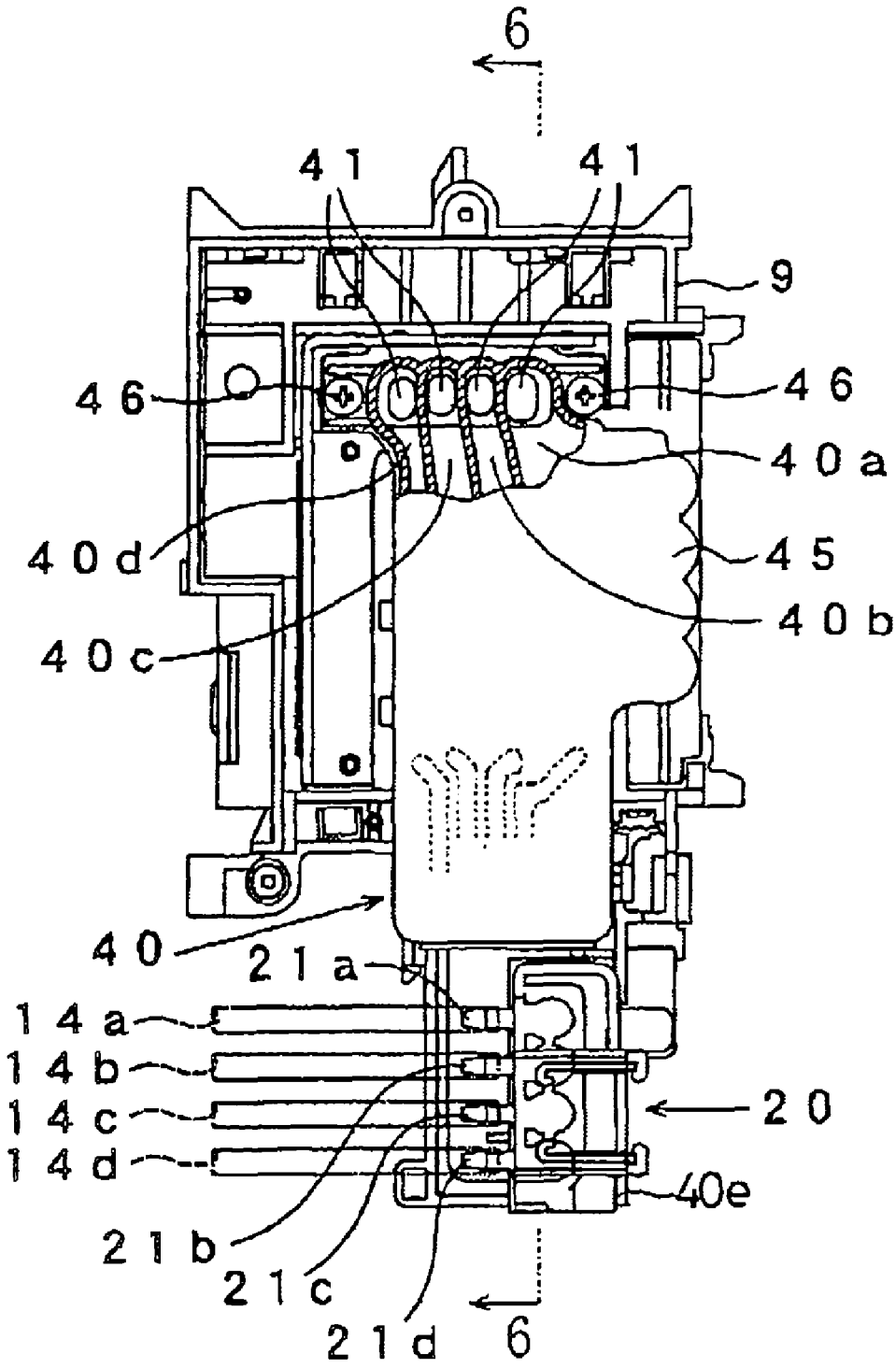
FIG. 2 is a plan view of a head holder in the inkjet printer as seen from one of two opposite sides thereof.

As shown in FIG. 2, the ink tank 40 has an arm portion 40*e* to which a tube joint 20 is attached. The tube joint 20 includes connecting ports 21*a*-21*d* to which the ink supply tubes 14*a*-14*d* are connected. The connecting ports 21*a*-21*d* are in communication with ink introducing openings 22*a*-22*d* (shown in FIGS. 4 and 6), respectively. A space inside the ink tank 40 is divided into four storing chambers that respectively accommodate or store the inks introduced through the ink introducing openings 22*a*-22*d*.

Figure 3:
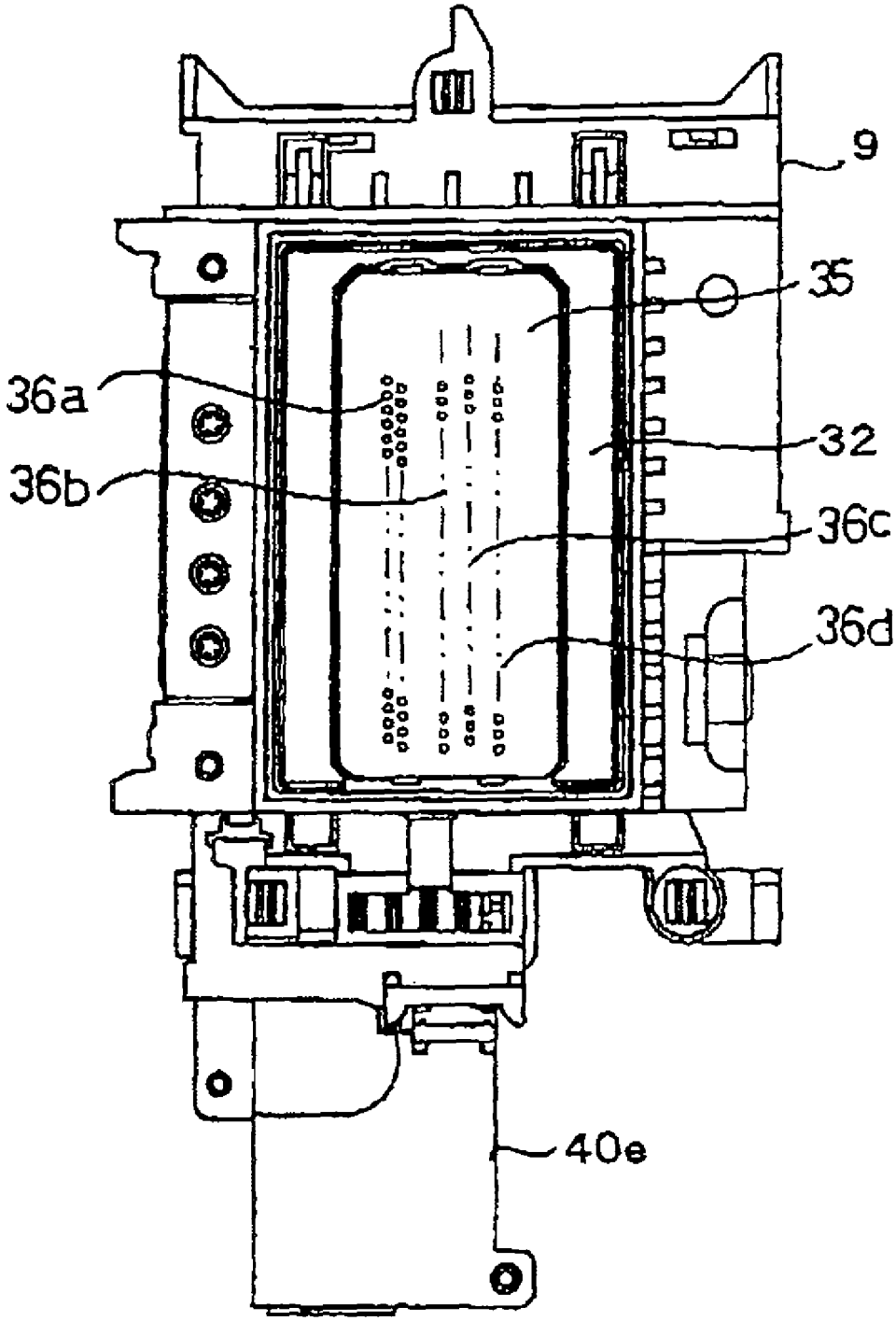
FIG. 3 is a plan view of the head holder as seen from the other side thereof where a nozzle surface is disposed.

As shown in FIG. 3, the head unit 30 includes a cavity unit 32 and a piezoelectric actuator 31. A lower surface of the cavity unit 32 is a nozzle surface 35 in which nozzle rows 36*a*-36*d* are arranged. The nozzle rows 36*a*-36*d* include two rows 36*a* of nozzles from which droplets of the black ink are to be ejected, a row 36*b* of nozzles from which droplets of the cyan ink are to be ejected, a row 36*c* of nozzles from which droplets of the magenta ink are to be ejected, and a row 36*d* of nozzles from which droplets of the yellow ink are to be ejected. The piezoelectric actuator 31 is for selectively pressurizing the ink in the nozzles or pressure chambers communicated therewith, to eject the ink as droplets from the nozzles. The nozzles are formed to be opposed to the recording medium P so that ink droplets are ejected from the nozzles onto the recording medium P when the piezoelectric actuator 31 is driven.

There will be described the head holder 9 and members held thereby, by referring to FIGS. 4 and 5.

Figure 4:
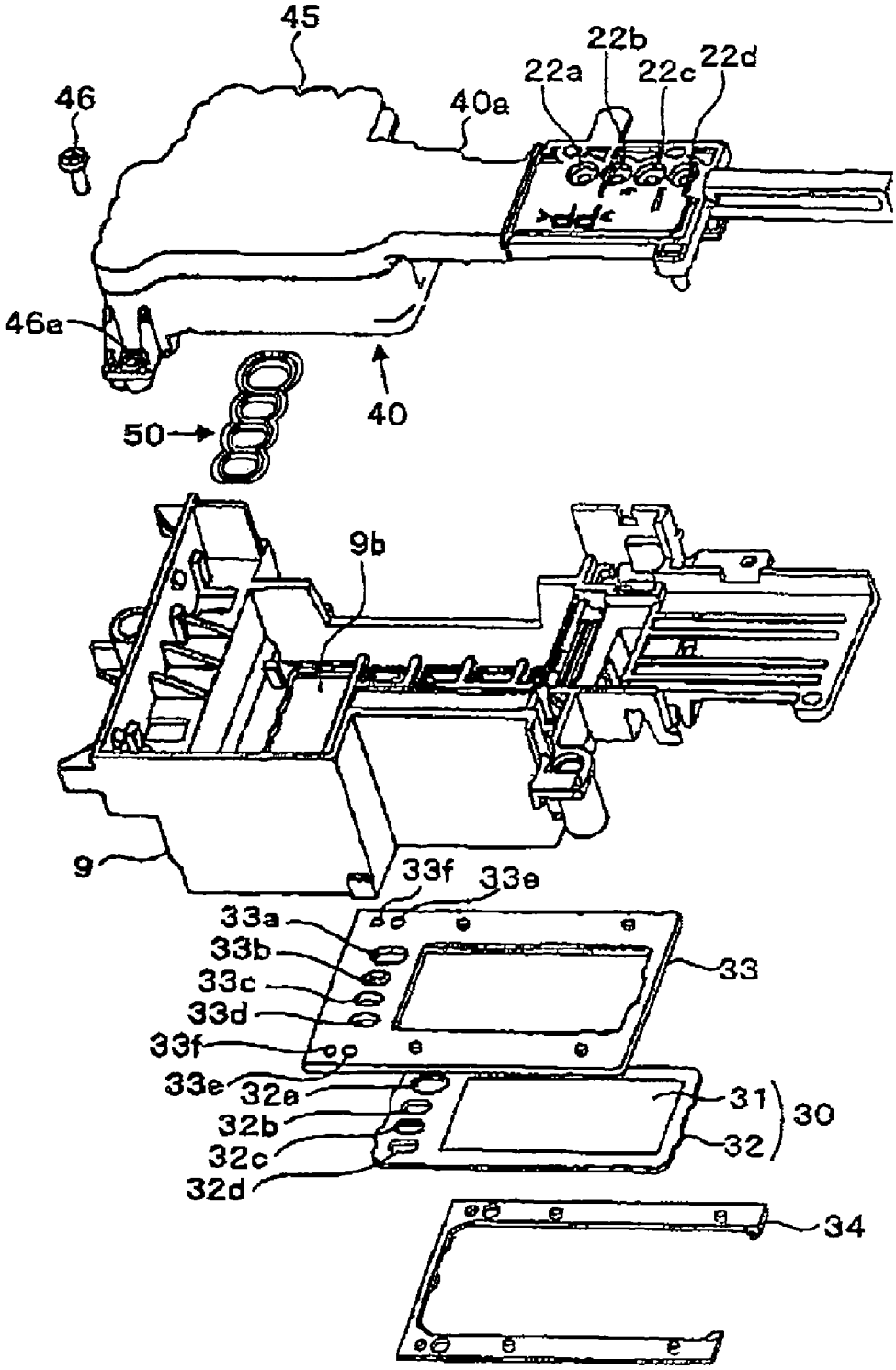
FIG. 4 is an exploded perspective view of the head holder and members held by the head holder including an ink tank.

As shown in FIG. 4, a reinforcing frame 33 and a lower frame 34 are bonded with an adhesive to an upper surface and an under surface of the head unit 30, respectively. Ink inlet ports 32*a*-32*d* are formed in an upper surface of the cavity unit 32, namely, in a portion of the upper surface of the head unit 30 where the piezoelectric actuator 31 is not disposed. The inks are introduced into the cavity unit 32 through the respective ink inlet ports 32*a*-32*d*. The ink inlet ports 32*a*-32*d* are communicated with respective through-holes 33*a*-33*d* formed in an end portion of the reinforcing frame 33.

Above the head unit 30, the ink tank 40 storing the inks to be supplied into the cavity unit 32 of the head unit 30 is disposed. In the ink tank 40, a predetermined amount of air is accumulated by separating the air from the inks, so that the accumulated air damps an impact of the inks on an inner wall of the ink tank 40 as well as other members defining ink passages, upon the head holder 9 starts moving (i.e., reciprocating) or stops moving, thereby preventing change in an internal pressure of the cavity unit 32, which would otherwise deteriorate stability and uniformity in ink ejection characteristics of the head unit 30. The ink tank 40 is equipped with an exhaust device 45 that operates to discharge a part of the air accumulated in the ink tank 40 when the accumulated air exceeds a predetermined amount. That is, a surplus air is discharged out of the ink tank 40 by the exhaust device 45.

Figure 5:
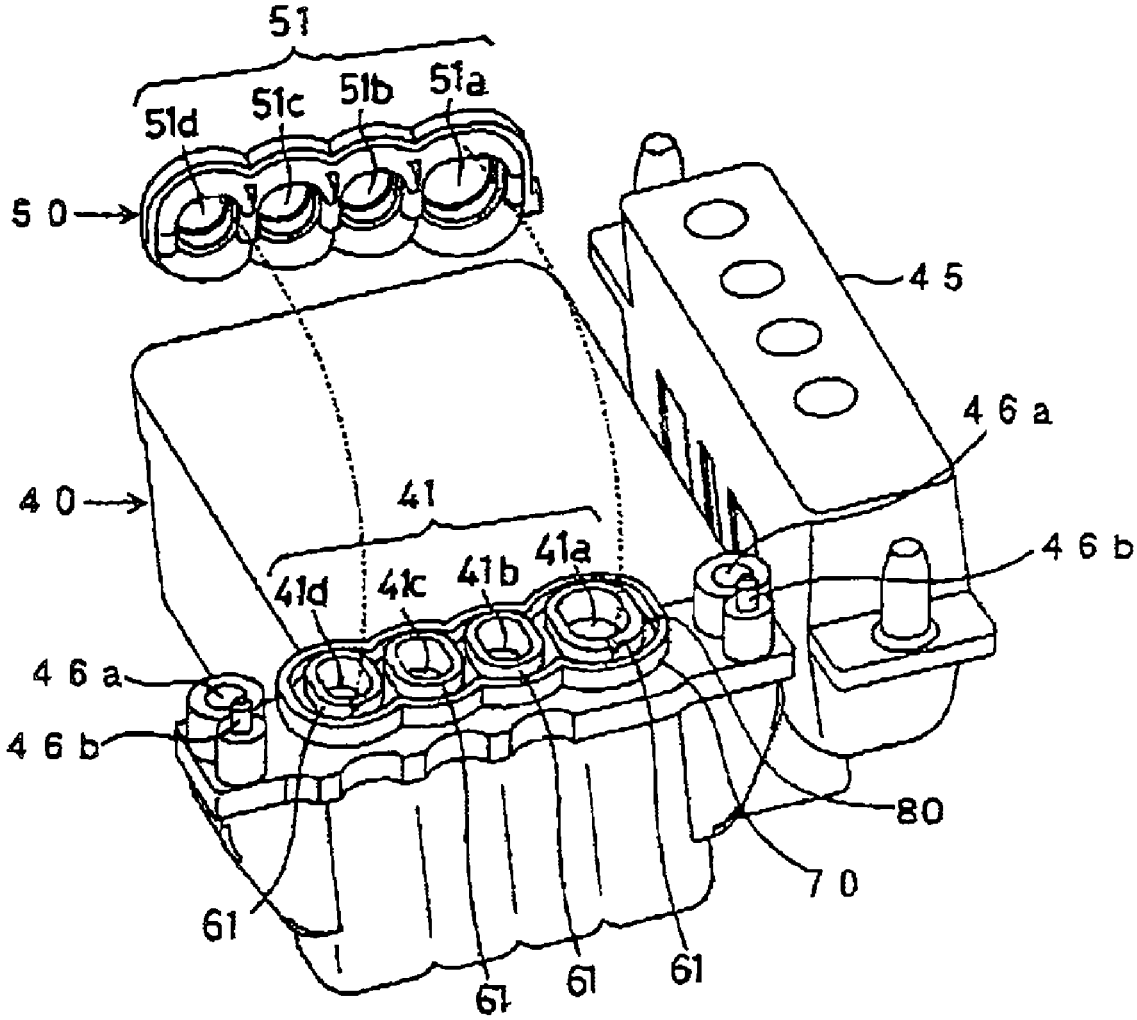
FIG. 5 is a perspective bottom view of the ink tank.

FIG. 5 is a perspective view showing the ink tank 40 with an under surface thereof facing upward. As shown in FIG. 5, four ink outlet ports 41 are formed in the under surface of the ink tank 40 (which is at the upper side in FIG. 5), and an elastic member 50 is fitted between the under surface of the ink tank 40 and an upper surface of the reinforcing frame 33, at a position corresponding to the ink outlet ports 41, as described below. The ink outlet ports 41 are individually designated by reference numerals 41*a*, 41*b*, 41*c* and 41*d*, that are respectively for the black, cyan, magenta and yellow inks. The ink outlet ports 41 are connected to the ink inlet ports 32*a*-32*d* via through-holes 51 (described later) formed in the elastic member 50 and the through-holes 33*a*-33*d* formed in the reinforcing frame 33. Hence, the inks stored in the ink tank 40 flow out of the ink tank 40 into the cavity unit 32 of the head unit 30 through the ink outlet ports 41 of the ink tank 40, the through-holes 51 of the elastic member 50, the through-holes 33*a*-33*d* of the reinforcing frame 33, and the ink inlet ports 32*a*-32*d* of the cavity unit 32. Open ends of the ink outlet ports 41*a*-41*d* are encircled by a double rib, namely, respective inner ribs 61 and a single outer rib 70. A recessed portion or groove 80 is defined between the inner ribs 61 and the outer rib 70.

Figure 9A:
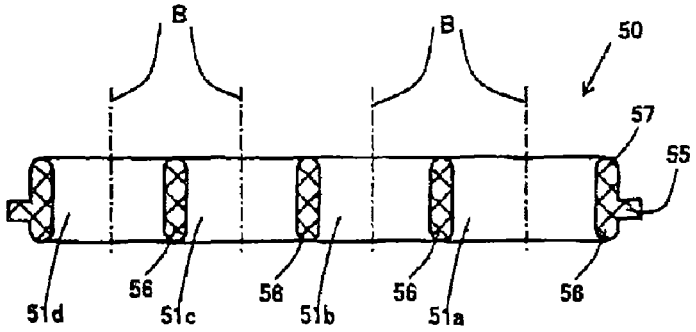
FIG. 9A is a longitudinal cross-sectional view of the elastic member.
Figure 9B:
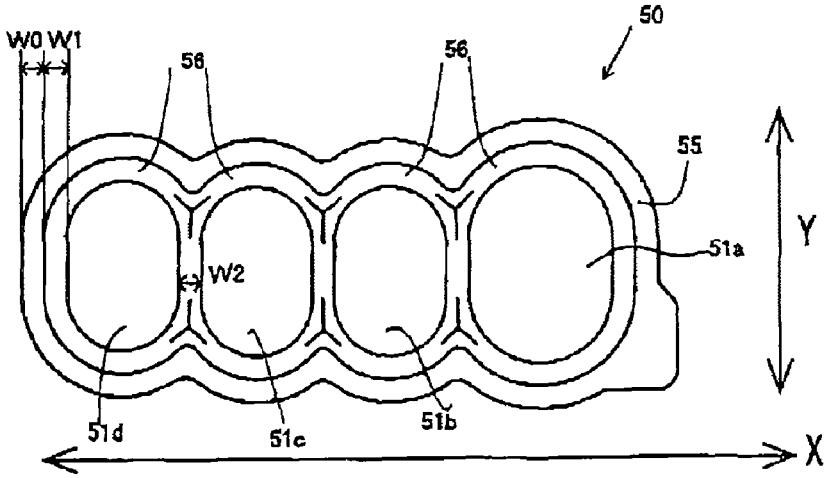
FIG. 9B is a plan view of the elastic member as seen in a direction of an axial direction B (indicated in FIG. 9A) of through-holes of the elastic member.
Figure 9C:
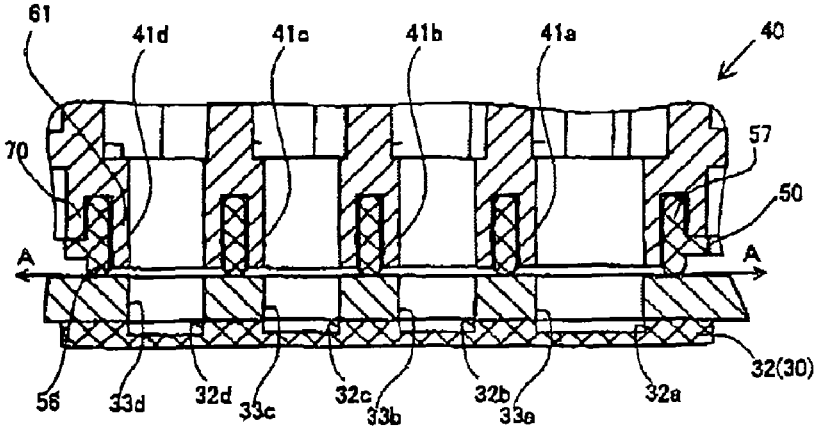
FIG. 9C is a cross-sectional view where the elastic member is interposed between a reinforcing frame disposed immediately over the head unit, and the ink tank.

There will be described the elastic member 50. The elastic member is formed of an elastic material and includes a flat plate-like body 55. As shown in FIGS. 9A-9C, four through-holes 51*a*-51*d* are formed in the plate-like body 55 such that the through-holes 51*a*-51*d* are arranged in a row extending in a direction X, in order to be opposed to a row of the through-holes 33*a*-33*d* of the reinforcing frame 33 and a row of the inlet ports 32*a*-32*d*, and a row of the ink outlet ports 41*a*-41*d*. An axial direction B of the through-holes 51 is perpendicular to a direction in which the plate-like body 55 extends continuously around the through-holes 51. In plan view, each of the through-holes 51 has a shape long in a direction Y that is substantially perpendicular to the direction X. Each of two opposite sides of each through-hole 51, which are adjacent to another through-hole 51 or at an outermost position in the row of the through-holes 51, is substantially linear and longer than the other sides of the through-holes 51.

Among the ink outlet ports 41*a*-41*d*, the one 41*a* from which the black ink flows out has a cross-sectional area larger than that of the other ink outlet ports 41*b*-41*d*. Hence, the one 51*a* of the through-holes 51 that corresponds to the ink outlet port 41*a* for the black ink has a cross-sectional area larger than that of the other through-holes 51*b*-51*d*. As described above, the reinforcing frame 33 is superposed on the upper surface of the head unit 30 and integrated with the head unit 30, so that the ink outlet ports 41*a*-41*d* of the ink tank 40 communicate with the through-holes 33*a*-33*d* of the reinforcing frame 33 and accordingly with the ink inlet ports 32*a*-32*d* via the through-holes 51*a*-51*d* of the elastic member 50. The reinforcing frame 33 may be omitted depending on the situation.

The plate-like body 55 has two opposite surfaces, namely, an inlet-side surface on the side of the ink inlet ports 32*a*-32*d* or the head unit 30, and an outlet-side surface on the side of the ink outlet ports 41*a*-41*d* or the ink tank 40. A first protruding portion 56 is formed on the inlet-side surface, and a second protruding portion 57 is formed on the outlet-side surface. The first and second protruding portions 56, 57 protrude in the axial direction B of the through-holes 51 to encircle open ends of the respective through-holes 51*a*-51*d* on the respective sides. That is, the elastic member 50 contacts at its first protruding portion 56 with a portion of the upper surface of the reinforcing frame 33 around the through-holes 33*a*-33*d* in order to connect the through-holes 51 of the elastic member 50 with the respective through-holes 33*a*-33*d* of the reinforcing frame 33, and contacts at its second protruding portion 57 with a portion of the under surface of the ink tank 40 around the ink outlet ports 41*a*-41*d* in order to connect the through-holes 51 with the ink outlet ports 41*a*-41*d*. Thus, communication between the ink outlet ports 41*a*-41*d* of the ink tank 40 and the through-holes 33*a*-33*d* in the reinforcing frame 33 is established.

As described above, each of the first protruding portion 56 and the second protruding portion 57 is formed to encircle the open ends of the elongate through-holes 51*a*-51*d*. Thus, each of the first and second protruding portions 56, 57 includes four elongate annular portions each of which is long in the direction Y. In other words, each of the first and second protruding portions 56, 57 has four elongate inner circumferential surfaces. Hence, each of the first and second protruding portions 56, 57 includes three partition walls each of which separates two adjacent through-holes 51, and two outermost walls each of which extends in the axial direction B from two opposite outermost portions, in the direction X, of the plate-like body 55. Each partition and outermost wall is substantially linear and longer than another wall as a portion of the first or second protruding portion 56, 57 that continues from the partition or outermost wall to extend generally along the direction X. A width W1 of each of the first and second protruding portions 56, 57, which is a dimension thereof in a direction perpendicular to the axial direction B of the through-holes 51, is uniform over an entire circumference of the plate-like body 55, and a width or thickness W2 of the partition wall separating each two adjacent through-holes 51 from each other equals W1. Thus, the inner circumferential surfaces of the first protruding portion 56 and the inner circumferential surfaces of the second protruding portion 57 are continuous with inner circumferential surfaces of the through-holes 51*a*-51*d*. That is, in cross section, the inner circumferential surface of each of the through-holes 51*a*-51*d* is flush with the inner circumferential surface of a corresponding one of the first protruding portions 56 and the inner circumferential surface of a corresponding one of the second protruding portions 57, to cooperate to form a smooth straight surface, as shown in FIG. 9A.

Heights of the first and second protruding portions 56, 57, which are dimensions thereof in the axial direction B of the through-holes 51, are determined such that an overall height of the elastic member 50, i.e., a sum of the heights of the first and second protruding portions and a thickness of the plate-like body 55 which is a dimension thereof in the axial direction B, is about three times the width W1 (=W2) of the first and second protruding portions 56, 57 or larger. The width W1 or W2 of the first and second protruding portions 56, 57 is almost the same as the thickness of the plate-like body 55. The height of the second protruding portion 57 is larger than that of the first protruding portion 56.

Along almost an entire circumference of the plate-like body 55, a dimension between an outer circumferential surface of the first and second protruding portions 56, 57 and an extreme edge of the plate-like body 55 is set at about W0, thereby uniforming closeness of contact between the outer rib 70 on the ink tank 40 and a portion of the plate-like body 55 around the through-holes 51, along the entire circumference of the plate-like body 55. The contact between the outer rib 70 and the plate-like body 55 will be described later.

As shown in FIG. 9C, a dimension of each of the through-hole 33*a*-33*d* in the direction X is substantially identical with that of the respectively corresponding one of the ink inlet ports 32*a*-32*d* and that of the respectively corresponding one of the ink outlet ports 41*a*-41*d*. Similarly, a dimension of each of the through-holes 33*a*-33*d* in the direction Y is substantially identical with that of the respectively corresponding one of the ink inlet ports 32*a*-32*d* and that of the respectively corresponding one of the ink outlet ports 41*a*-41*d*. A dimension of each of the through-holes 51*a*-51*d* in the direction X is larger than the dimensions, in the same direction, of the respectively corresponding one of the through-holes 33*a*-33*d*, of the respectively corresponding one of the ink inlet ports 32*a*-32*d*, and of the respectively corresponding one of the ink outlet ports 41*a*-41*d*. A dimension of each of the through-holes 51*a*-51*d* in the direction Y is larger than the dimensions, in the same direction, of the respectively corresponding one of the through-holes 33*a*-33*d*, of the respectively corresponding one of the ink inlet ports 32*a*-32*d*, and of the respectively corresponding one of the ink outlet ports 41*a*-41*d*. Accordingly, a width of a portion of the upper surface of the reinforcing frame 33 which a portion of the first protruding portion 56 between each two adjacent through-holes 51 is opposed to and contacted with when the elastic member 50 is assembled to be interposed between the ink tank 40 and the reinforcing frame 33, as described later, i.e., an interval between each two adjacent through-holes 33*a*-33*d*, is larger than the width W2 of the first protruding portion 56 in order that each of the two opposite outermost walls of the first protruding portion 56 is opposed to the upper surface of the reinforcing frame 33 at a position on the outer side, in the direction X, of an open end of an outermost one (33*a*, 33*d*) of the through-holes 33*a*-33*d* of the reinforcing frame 33, with spacing from the open end. Hence, the first protruding portion 56 and the reinforcing frame 33 are contacted with each other to ensure sealability even when the first protruding portion 56 is positioned with an error relative to the reinforcing frame 33.

Figure 6:
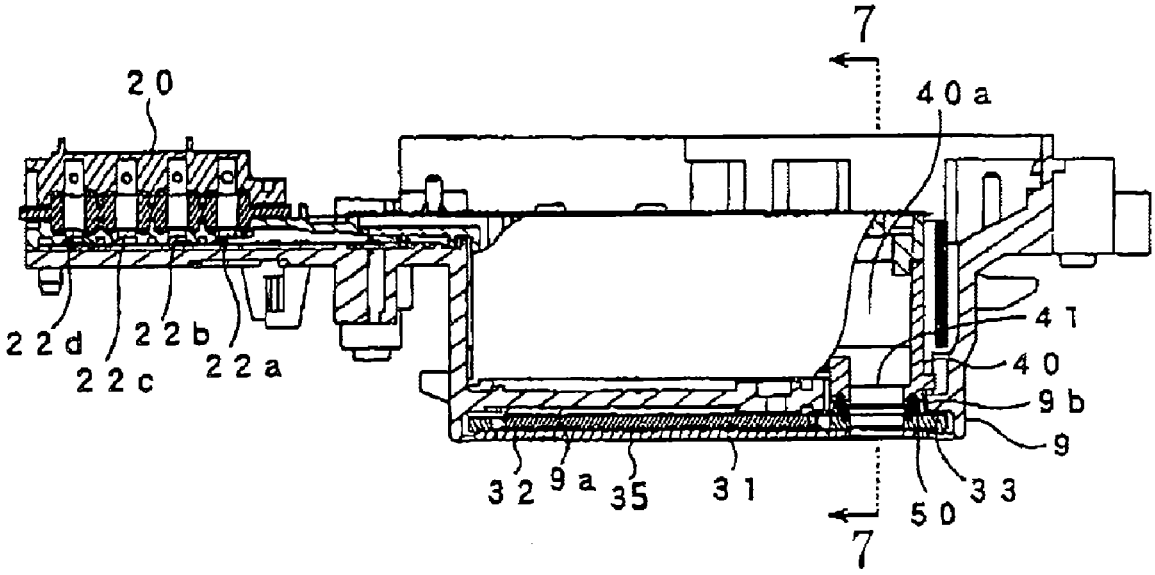
FIG. 6 is a cross-sectional view taken along line 6-6 in FIG. 2.
Figure 7:
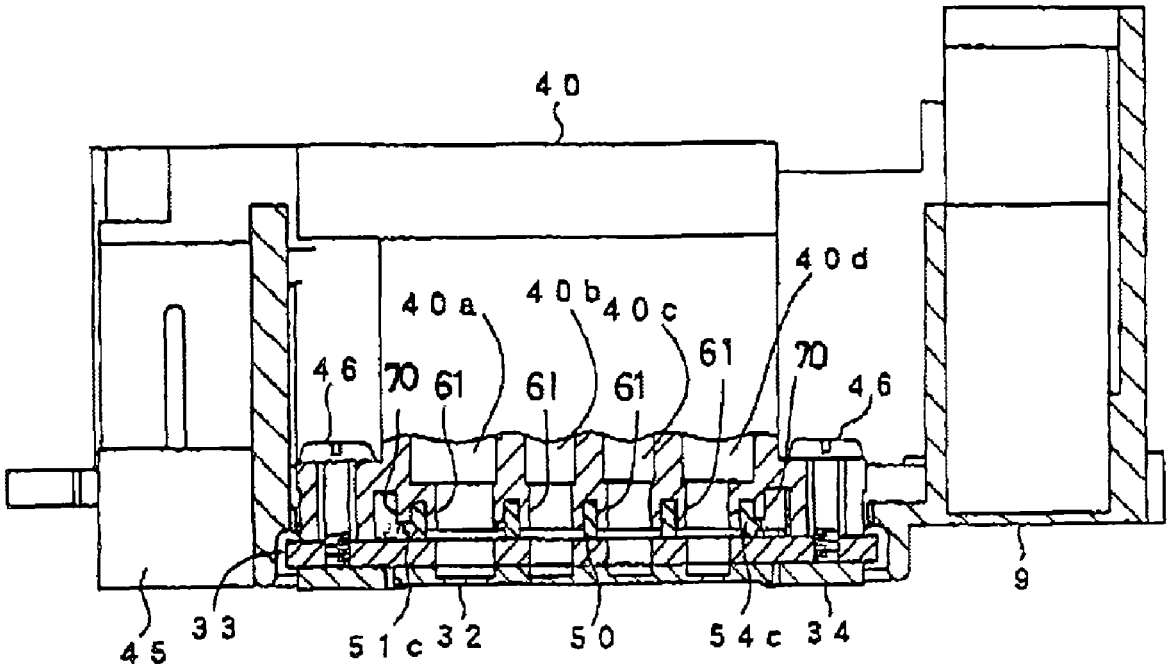
FIG. 7 is a cross-sectional view taken along line 7-7 in FIG. 6, and shows an elastic member and a head unit shown in FIG. 4 and the ink tank, as assembled.

There will be now described how the elastic member 50, the ink tank 40, and the head unit 30 are assembled. As shown in FIG. 6, the reinforcing frame 33 is initially bonded to an under surface 9*a* of a bottom plate of the head holder 9. At this time, the reinforcing frame 33 and the head unit 30 are integral, that is, the head unit 30 is already bonded to an under surface of the reinforcing frame 33. As briefly mentioned above, the annular inner ribs 61 are formed around the respective open ends of the ink outlet ports 41*a*-41*d* on the under side of the ink tank 40, and the single outer rib 70 is formed to continuously encircle all the inner ribs 61. As assembled, the inner ribs 61 and the outer rib 70 extend toward the reinforcing frame 33 such that an amount of the extension of the inner ribs 61 is larger than that of the outer rib 70.

Then, the elastic member 50 is attached to the ink tank 40 such that the second protruding portion 57 of the elastic member 50 is fitted in the groove 80 defined between the inner ribs 61 and the outer rib 70 on the ink tank 40. Subsequently, the ink tank 40 is inserted into the head holder 9 from the upper side, with the ink outlet ports 41*a*-41*d* of the ink tank 40 inserted into an opening 9*b* formed in the bottom plate of the head holder 9. Two pins 46*b* (shown in FIG. 5) protrude from the under surface of the ink tank 40 at opposite sides of the row of the ink outlet ports 41*a*-41*d*, and these pins 46*b* are fitted in respective positioning holes 33*f* (shown in FIG. 4) formed in the reinforcing frame 33, thereby making the under surface of the ink tank 40 opposed to the reinforcing frame 33 with the ink outlet ports 41*a*-41*d* aligned with the through-holes 33*a*-33*d* in the reinforcing frame 33.

Figure 8:
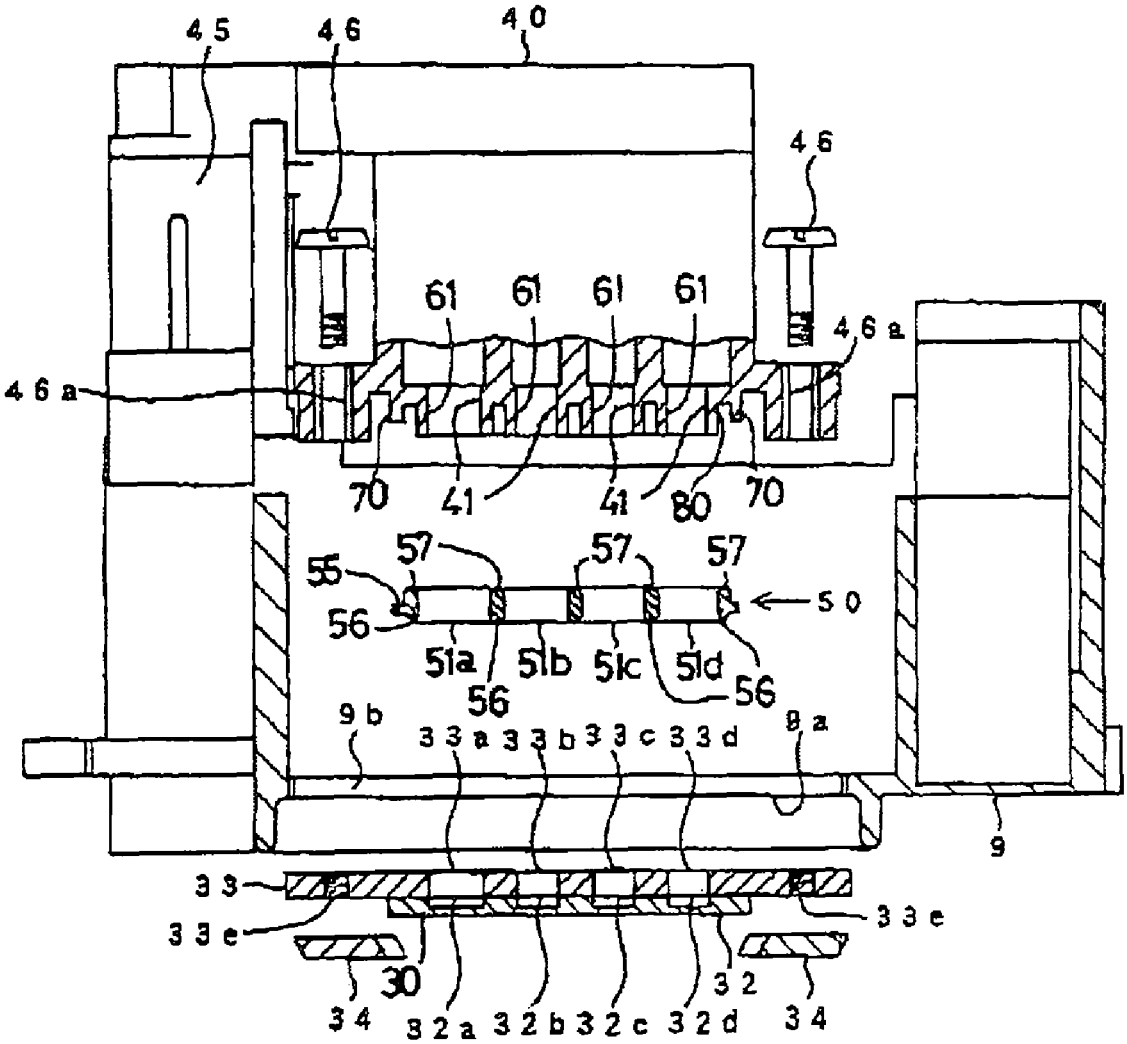
FIG. 8 is a cross-sectional view corresponding to FIG. 7 and shows the elastic member, head unit and ink tank as disassembled.

Then, two attaching screws 46 (shown in FIGS. 2, 4, 7 and 8) are inserted through respective through-holes 46*a* (shown in FIGS. 4, 5 and 8) formed at opposite sides of the ink tank 40. End portions of the attaching screws 46 protruding from the through-holes 46*a* are screwed into screw holes 33*e* (shown in FIGS. 4 and 8) formed in the reinforcing frame 33. In this way, the ink tank 40 is fixed to the head unit 30, more strictly, to the reinforcing frame 33 that is integrated with the head unit 30, via the elastic member 50, with the ink outlet ports 41*a*-41*d* of the ink tank 40 being communicated with the ink inlet ports 32*a*-32*d* of the cavity unit 32 of the head unit 30 via the through-holes 51*a*-51*d* of the elastic member 50 and the through-holes 33*a*-33*d* of the reinforcing frame 33, as shown in FIGS. 6 and 9C.

When the attaching screws 46 are screwed into the screw holes 33*e* in the reinforcing frame 33, the elastic member 50 is vertically compressed between the ink tank 40 and the head unit 30 (or more strictly the reinforcing frame 33), that is, a compressing force is imparted on the elastic member 50 in the axial direction B, as shown in FIG. 9C. When the elastic member 50 is compressed in this way, the outer rib 70 on the under surface of the ink tank 40 is closely contacted with an upper surface of the plate-like body 55, and a lower end portion of the first protruding portion 56 is contacted with the reinforcing frame 33 to be compressed. Hence, the ink outlet ports 41*a*-41*d* and the ink inlet ports 32*a*-32*d* are communicated with each other with sealability or liquid-tightness from the exterior.

To ensure the sealability, the height or dimension in the axial direction B of the first protruding portion 56 should be determined in order that the first protruding portion 56 can accommodate variation in the compressing force imparted to compress the first protruding portion 56. When the height of the first protruding portion 56 is too small a reacting force from the elastic member 50 to the compressing force may act on the ink tank 40 or the head unit 30 to cause deformation of the ink tank 40 or head unit 30. On the other hand, when the height of the first protruding portion 56 is too large, the first protruding portion 56 tends to incline when compressed. However, as described later, such inclination of the first protruding portion 56 can be restricted by presence of the inner ribs 61. Hence, the height of the first protruding portion 56 can be made relatively large.

The height of the second protruding portion 57 of the elastic member 50 is made larger than a depth of the groove 80 so that when the elastic member 50 is interposed and fitted between the ink tank 40 and the reinforcing frame 33, a bottom surface of the groove 80 contacts the second protruding portion before the outer rib 70 contacts the plate-like body 55 to press the plate-like body 55 downward. Hence, it is possible to compress the second protruding portion 57 so as to maintain liquid-tightness or sealability at each of the through-holes 51.

In this way, the heights of the first protruding portion 56 and the second protruding portion 57 of the elastic member 50 are made large enough to accommodate the variation in the compressing force to enable to ensure sealability at the through-holes 51.

In the above-described conventional sealing structure devised by the present applicant, individual first protruding portions encircle the respective open ends of the elongate through-holes of the elastic member, and a wall of one of two adjacent first protruding portions which extends along a longitudinal direction of the elongate through-holes and a wall of the other of the two adjacent first protruding portions extending in the same direction are juxtaposed to each other. In other words, two walls are present between each two adjacent through-holes of the elastic member Hence, the compressing force received by a portion of the elastic member between two adjacent through-holes is evenly distributed to the two walls of two adjacent first protruding portions. On the other hand, according to the present embodiment, the compressing force imparted on the same portion of the elastic member 50 is received by the lower end portion of a single partition wall of the first protruding portion 56 integrally formed. Hence, the first protruding portion 56 of the present embodiment more tends to deform to incline, compared to the first protruding portions of the conventional sealing structure. The first protruding portion 56 of the present embodiment particularly tends to incline at its linear, longer walls, namely, at the partition walls and the outermost walls. To solve this problem, the inner ribs 61 on the under surface of the ink tank 40 are formed to extend in the axial direction B along the inner circumferential surfaces of the through-holes 51 down to a position or level where the first protruding portion 56 is present. The inner ribs 61 are allowed to extend to a position or level where lower ends of the inner ribs 61 are located very close to the reinforcing frame 33 but do not contact the reinforcing frame 33 when the first protruding portion 56 is compressed. That is, the double rib, which is configured such that the groove 80 is defined between the inner ribs 61 and the outer rib 70 with the inner ribs 71 extending in the axial direction B more greatly than the outer rib 70, contributes to prevention of inclination of the first protruding portion 56, and particularly inclination in the inward direction. Further, since the amount in which the inner ribs 61 extends in the axial direction B is adjusted such that the inner ribs 61 do not contact the reinforcing frame 33, the elastic member 50 can be compressed by an amount sufficient to ensure the liquid-tightness or sealability of the sealing structure, while preventing the first protruding portion 56 from inclining inward.

Figure 10:
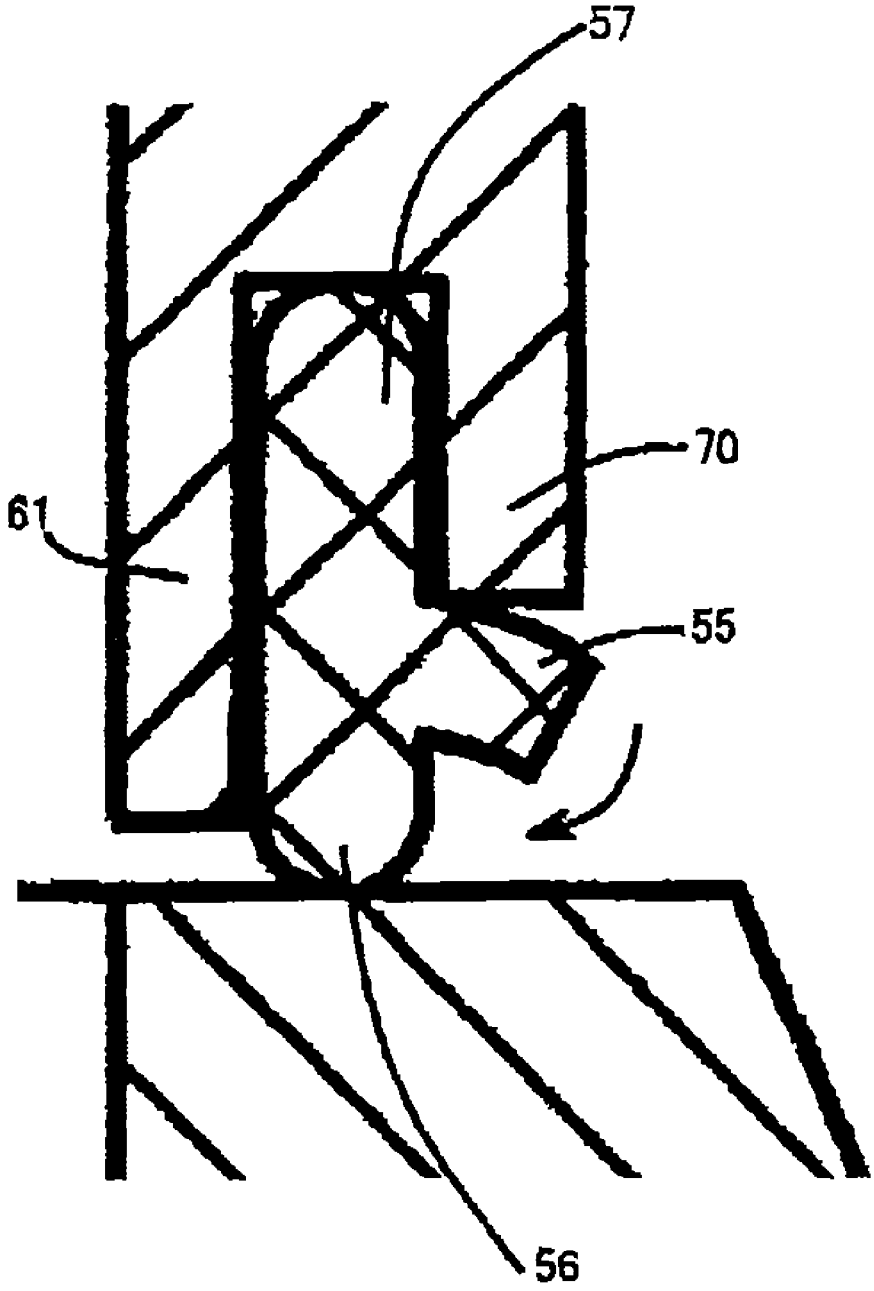
FIG. 10 illustrates how a moment is applied to a plate-like body and a first protruding portion of the elastic member.

A contact area at which the outer rib 70 contacts the upper surface, i.e., the outlet-side surface, of the plate-like body 55 of the elastic member 50 is substantially uniform along the entire circumference of the plate-like body 55, thereby ensuring high liquid-tightness or sealability. Since the outer rib 70 extends along the axial direction B, the linear longer sides of the first protruding portion 56 at the outermost portions of the elastic member 50 are prevented from inclining outward. That is, when the elastic member 50 is compressed, the outermost walls of the first protruding portion 56 receive a force acting to incline the outermost walls inward or outward, but the presence of the inner ribs 61 restricts the inward inclination, and the outward inclination is inhibited since the outer rib 70 is extended to push the plate-like body 55 toward the reinforcing frame 33 and a moment to inward push the first protruding portion 56 along with the plate-like body 55 is applied, as shown in FIG. 10. Thus, the first protruding portion 56 is compressed by being pressed against the upper surface of the reinforcing frame 33 by a great force, thereby ensuring high liquid-tightness or sealability.

According to the present sealing structure where the under surface of the ink tank 40 has the groove 80 in which the second protruding portion 57 of the elastic member 50 is fitted, the elastic member 50 is easily compressible. Further, the fitting of the second protruding portion 57 in the groove 80 prevents the elastic member 50 from being displaced or getting out of position, and prevents the first protruding portion 56 from greatly inclining when the elastic member 50 is compressed between the head unit 30 (or more strictly the reinforcing frame 33) and the ink tank 40. Thus, the ink tank 40 is stably connected with the head unit 30 or more strictly with the reinforcing frame 33, with high liquid-tightness or sealability and free from leakage of the inks. In addition, since the through-holes 51 have an elongate shape, and the partition walls between two adjacent through-holes 51 and the outermost walls of the first and second protruding portions 156, 57 are linear and longer than the walls of the other portions of the first and second protruding portions 56, 57, a dimension of the row of the through-holes 51 in the direction X is reduced as compared to a case where the shape of through-holes of the elastic member is perfectly circular, thereby contributing to space saving. Although the elongate shape of the through-holes 51 necessitates inclusion of linear longer sides, which tend to incline, in the first and second protruding portions 56, 57, the liquid-tightness or sealability of the sealing structure can be ensured according to the features of the present embodiment as described above.

Although there has been described one embodiment of the invention, it is to be understood that the invention is not limited to the details of the above-described embodiment, but may be otherwise embodied with various modifications and improvements that may occur to those skilled in the art, without departing from the scope and spirit of the invention defined in the appended claims.

For instance, in the above-described embodiment, the first protruding portion 56 is formed on the inlet-side surface of the plate-like body 55 that is on the side of the ink inlet ports 32*a*-32*d*, and the second protruding portion 57 is formed on the outlet-side surface of the plate-like body 55 on the side of the ink outlet ports 41*a*-41*d*. However, the embodiment may be modified such that the first protruding portion 56 is formed on the outlet-side surface and the second protruding portion 57 is formed on the inlet-side surface. More specifically, it may be arranged such that the ink tanks 40 does not have the double rib and has a flat under surface and a protruding portion formed on the ink-outlet surface is simply contacted with the flat under surface, while the reinforcing frame 33 has a double rib like one formed on the ink tank 40 according to the above-described embodiment and a protruding portion formed on the ink-inlet surface is fitted in a groove of the double rib. Alternatively, the first protruding portion 56 may be formed on both of the inlet-side and outlet-side surfaces. More specifically, the embodiment may be modified such that the ink tank 40 does not have the double rib and has a flat under surface, and the second protruding portion 57 is simply contacted with the flat under surface and not fitted in the groove 80, so that the elastic member 50 is compressed between flat surfaces of the ink tank 40 and the reinforcing frame 33.

The invention is applicable not only to inkjet printers, but also to any apparatus in which two members are connected to supply a fluid from one of the members to the other member.

What is claimed is:

1. A sealing structure comprising:

a first passage-forming member having a surface in which open ends of one of (i) a plurality of fluid inlet ports, and (ii) a plurality of fluid outlet ports of the same number as the plurality of fluid inlet ports, are arranged;

a second passage-forming member having a surface in which open ends of the other one of (i) the plurality of fluid inlet ports and (ii) the plurality of fluid outlet ports, are arranged; and an elastic member interposed between the surface of the first passage-forming member and the surface of the second passage-forming member, the elastic member including:

a plate-like body having two opposite surfaces one of which is an inlet-side surface-on the side of the fluid inlet ports and the other of which is an outlet-side surface on the side of the fluid outlet ports;

through-holes which are formed perpendicularly to the plate-like body and through the elastic member, such that the fluid inlet ports and the fluid outlet ports are communicated with each other via the through-holes, and the open ends of the fluid inlet ports and the open ends of the fluid outlet ports are smaller than respectively opposed open ends of the corresponding through-holes;

a first protruding portion which protrudes from one of the inlet-side and outlet-side surfaces in an axial direction of the through-holes toward the surface of the first passage-forming member to form inner circumferential surfaces encircling the open ends of the respective through-holes, the first protruding portion being held in contact with the surface of the first passage-forming member;

a second protruding portion which protrudes from the other of the inlet-side and outlet-side surfaces in the axial direction of the through-holes toward the surface of the second passage-forming member to form inner circumferential surfaces encircling the open ends of the respective through-holes, wherein, an inner circumferential surface of one of the through-holes has a straight outline extending parallel to the axial direction of the through-holes when viewed in a cross sectional view of the through-holes, wherein a part of each of the first and second protruding portions located between each two adjacent through-holes being in the form of a common partition wall which separates the two adjacent through-holes from each other and extends along the axial direction of the through-holes, wherein the first and second protruding portions of the elastic member are interposed between the first and second passage-forming members and are configured to compress in the axial direction of the through-holes, wherein one of the surface of the first passage-forming member and the surface of the second passage-forming member has a groove accommodating a corresponding one of the first and second protruding portions, and the other of the surface of the first passage-forming member and the surface of the second passage-forming member is flat, wherein a grooved member comprises the one of the first and second passage-forming members which has the groove further comprises:

annular inner walls that extend from the surface of the grooved member in the axial direction of the through-holes to respectively encircle the open ends of the one of the fluid inlet ports and the fluid outlet ports that are arranged in the surface of the grooved member; and an annular outer wall that extends from the surface of the grooved member in the axial direction of the through-holes to encircle all the inner walls with a spacing therefrom, wherein a dimension of the outer wall in the axial direction is smaller than that of the inner walls, and wherein the groove is defined between the inner walls and the outer wall.

2. The sealing structure according to claim 1, wherein a height of one of the first and second protruding portions of the elastic member which is accommodated in the groove is larger than that of the other of the first and second protruding portions.

3. The sealing structure according to claim 1, wherein the groove is formed on the surface of the second passage-forming member, and the surface of the first passage-forming member is flat.

4. The sealing structure according to claim 1, wherein each of the surface of the first passage-forming member and the surface of the second passage-forming member is flat, the first and second protruding portions are respectively held in contact with the flat surfaces of the first and second passage-forming members, and the first and second protruding portions of the elastic member as interposed between the first and second passage-forming members are compressed in the axial direction of the through-holes.

5. The sealing structure according to claim 1, wherein the dimension of the inner walls in the axial direction of the through-holes is determined in order not to contact the surface of the one of the first and second passage-forming members which does not have the groove.

6. The sealing structure according to claim 5, wherein the outer wall contacts the plate-like body.

7. The sealing structure according to claim 1, wherein each of the first and second protruding portions has two outermost walls in a direction of arrangement of the through-holes, wherein each of the through-holes has an elongate shape narrow in the direction of arrangement of the through-holes, and wherein the common partition wall between each two adjacent through-holes and each of the outermost walls substantially linearly extend to correspond to a longer side of the elongate shape of thee through-holes.

8. The sealing structure according to claim 1, wherein a sum of a dimension of the first protruding portion, a dimension of the second protruding portion, and a dimension of the plate-like body, all of which are in the axial direction of the through-holes, is three times a width of the wall of the first and second protruding portions, or larger, the width being a dimension perpendicular to the axial direction.

9. The sealing structure according to claim 1, wherein a sum of a dimension of the first protruding portion, a dimension of the second protruding portion, and a dimension of the plate-like body, all of which are in the axial direction of the through-holes, is four times a width of the wall of the first and second protruding portions, or larger, the width being a dimension perpendicular to the axial direction.

10. The sealing structure according to claim 1, wherein the first and second passage-forming members are an ink supply member and an ink receiving member in an inkjet printer, or vice versa.

11. The sealing structure according to claim 10, wherein open ends of ink outlet ports as the fluid outlet ports are arranged in a surface of the ink supply member, and open ends of ink inlet ports as the fluid inlet ports are arranged in a surface of the ink receiving member, wherein the surface of the ink supply member has the groove accommodating a corresponding one of the first and second protruding portions, and the surface of the ink receiving member is flat, and wherein the first and second protruding portions of the elastic member as interposed between the ink supply member and the ink receiving member are compressed in the axial direction of the through-holes.

12. The sealing structure according to claim 1, wherein a portion of the one of the surface of the first passage-forming member and the surface of the second passage-forming member is a bottom surface of the groove and is configured to contact the one of the first and second protruding portions accommodated in the groove.

13. The sealing structure according to claim 1, wherein the through-holes are formed through the plate-like body from the inlet-side surface thereof to the outlet-side surface thereof.

14. The sealing structure according to claim 1, wherein the inner walls is configured to extend in the axial direction of the through-holes to a position where the other of the first and second protruding portions is present.

* * * * *